US005765619A

United States Patent [19]

Arnold

[11] Patent Number: 5,765,619

[45] Date of Patent: Jun. 16, 1998

[54] ARCHED WINDOW DRAPE APPARATUS

[76] Inventor: Martin J. Arnold, 11169 Sylvan Pond Cir., Orlando, Fla. 32825

[21] Appl. No.: 685,867

[22] Filed: Jul. 24, 1996

[51] Int. Cl.[6] ..... A47H 5/00

[52] U.S. Cl. ..... 160/84.07; 160/39; 160/134; 160/370.23

[58] Field of Search ..... 160/84.07, 84.06, 160/134, 39, 370.23

[56] References Cited

U.S. PATENT DOCUMENTS

| | | | |
|---|---|---|---|
| D. 295,935 | 5/1988 | Estabrook | D6/0 |
| D. 360,552 | 7/1995 | Lopez | D6/575 |
| 1,609,877 | 12/1926 | Kendall | 160/84.07 |
| 2,803,298 | 8/1957 | Schlesinger | 160/349 |
| 2,929,444 | 3/1960 | Mahlouff | 160/39 |
| 3,275,065 | 9/1966 | Maras | 160/330 |
| 3,372,728 | 3/1968 | Schaefer | 160/39 |
| 3,460,458 | 8/1969 | MacLeod | 160/84.06 X |
| 4,620,382 | 11/1986 | Sallis | 38/102.2 |
| 4,776,380 | 10/1988 | Lester | 160/134 |
| 4,825,611 | 5/1989 | Bassett | 160/84.07 |
| 4,936,418 | 6/1990 | Clausen | 184/106 |
| 5,044,418 | 9/1991 | Donahue | 160/84.07 X |
| 5,050,661 | 9/1991 | Sikkema et al. | 160/84.07 |
| 5,183,092 | 2/1993 | Jelic | 160/84.07 |
| 5,219,407 | 6/1993 | Lloyd | 160/84.07 X |
| 5,471,789 | 12/1995 | Faircloth | 160/84.07 X |

*Primary Examiner*—Harry C. Kim
*Assistant Examiner*—Bruce A. Lev
*Attorney, Agent, or Firm*—William M. Hobby, III

[57] ABSTRACT

An arched window covering includes a flexible fabric drape having a passageway formed on two sides thereof with one passageway extending over an elongated drape support rod having two ends. The support rod has each end attached to one end portion of an elongated base to form an arcuate rod attached to two ends of a linear elongated base. A flexible cord is attached through the other passageway of the fabric drape and is pulled to bunch the drape together. It is attached to cord attaching brackets on the base between the end portions of the base to thereby form an arched drape for covering an arched window. An elongated base can be formed of a plurality of members which can be adjusted to vary the length of the base and to thereby vary the arc of the elongated drape support rod. The method includes selecting an elongated base and a fabric drape having passageways on either side thereof and an elongated drape supporting rod and attaching the fabric drape to the selected rod through the passageway and attaching each end of the elongated rod to the end portion of the base and then drawing the cord through the fabric drape passageway to bunch one side of the drape together and then attach the cord to the base.

5 Claims, 2 Drawing Sheets

ARCHED WINDOW DRAPE APPARATUS

BACKGROUND OF THE INVENTION

The present invention relates to drapes and especially to arched window coverings which can be easily formed for different size arched windows.

In the past, drapes and window coverings have been provided for all types of windows. Most are directed towards a typical rectangular shaped window in which the drape is attached to a drapery hanging rod or the like over the window so that the drape hangs in folds in front of the window. In addition, there have been drapes which attach to rods at each end of a window especially for use on windows through doors and the like to stretch the drape material over the window. Other window coverings must include venetian or slated blinds which can be adjusted to vary light entering through a window opening and also pull down shades, which can be pulled down to cover a window.

The present invention relates to a window covering or drape for an arched window, which windows have become popular in building construction in recent years. The windows are more difficult to cover because of the curved surface along the top of the window. Thus, the standard venetian blind, shades, and drapes will not fit the curved surface of the window. In addition, since arched windows come in a wide variety of sizes with a variety of arched surfaces, it has required custom window coverings for the windows. This in turn increases the cost and time necessary to make and install the special window coverings for the windows. The present invention provides an arched window covering which can be readily adjusted for different sized windows and arcs and which can be made up in standard sizes for fitting a wide variety of sizes of arched windows which can be assembled and attached by the home owner directly or by installers without having to have custom drapes made for the windows.

The prior art U.S. patent to Estabrook, Design U.S. Pat. No. 295,935, teaches a curtain which has the top and bottom attached to a rosette and which is bunched together in the center and covered with a rosette design. In the Design patent to Lopez, No. D360,552, an arched window covering is provided which appears to have an arched frame support and the curtain pulled with an elongated center attachment. The Bergstrom patent is a conventional rectangular storm window protector which has a drape pulled between rods at either end thereof. The Clausen U. S. Pat. No. 4,936,418, is an oil drip collector but shows means of attaching in a curved shape with stretching members. The Sallis U.S. Pat. No. 4,620,382, shows an apparatus for tensioning a heliostat membrane which wraps a membrane around a circular frame. The Maras U.S. Pat. No. 3,275,065, shows a curtain for a rectangular type window which bunches the drape together with a flexible chain placed through the bottom of the drape. The Schlesinger U.S. Pat. No. 2,803,298, teaches a window shading device having the shade attached in the center of the top portion of the window and means for bunching the shade to either side of the window to form a generally V-shape opening.

In contrast to the prior art, the present invention deals with a prefabricated arched window covering which can be readily assembled and can be adjusted for different size windows on the spot and quickly assembled and attached to the window.

SUMMARY OF THE INVENTION

An arched window covering includes a flexible fabric drape having a passageway formed on two sides thereof with one passageway extending over an elongated drape support rod having two ends. The support rod has each end attached to one end portion of an elongated base to form an arcuate rod attached to two ends of a linear elongated base. A flexible cord is attached through the other passageway of the fabric drape and is pulled to bunch the drape together. It is attached to cord attaching brackets on the base between the end portions of the base to thereby form an arched drape for covering an arched window. An elongated base can be formed of a plurality of members which can be adjusted to vary the length of the base and to thereby vary the arc of the elongated drape support rod. The method includes selecting an elongated base and a fabric drape having passageways on either side thereof and an elongated drape supporting rod and attaching the fabric drape to the selected rod through the passageway and attaching each end of the elongated rod to the end portion of the base and then drawing the cord through the fabric drape passageway to bunch one side of the drape together and then attach the cord to the base.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
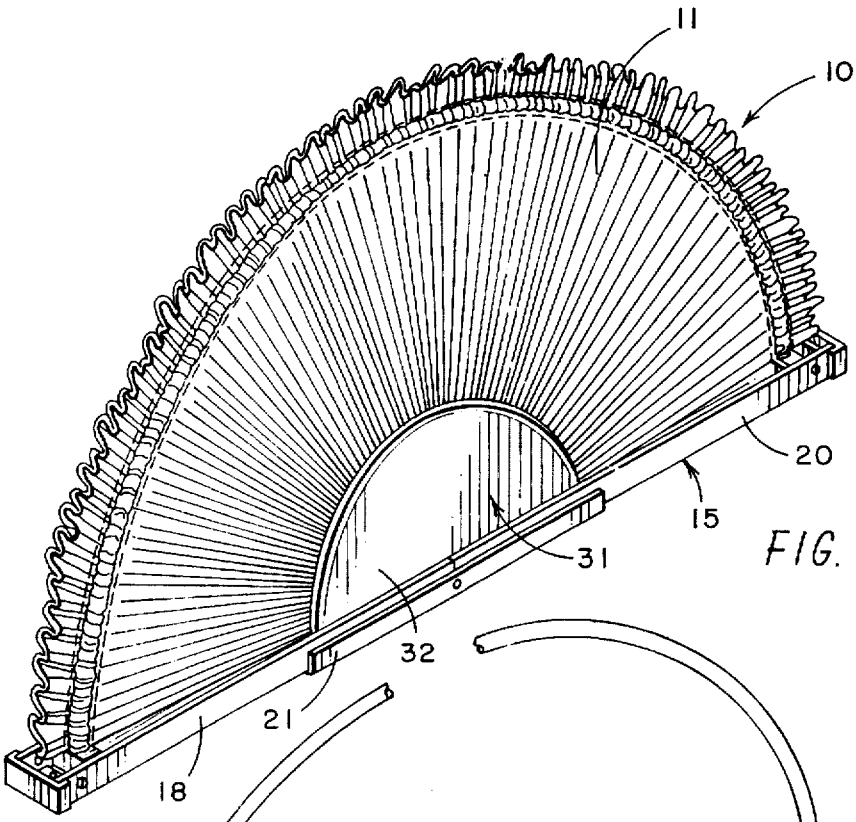
FIG. 1 is a perspective view of an arched window covering in accordance with the present invention.

Referring to the drawings FIGS. 1 through 4, an arched window covering 10 has a fabric drape 11 attached thereto which drape has a formed passageway 12 on one side thereof and a formed passageway 13 on the second side thereof. The passageway 12 is attached to an elongated drape rod 14 while the drape rod 14 has been attached at either end thereof to an elongated base 15. The metal or fiberglass rod 14 can be bent or arched as shown and have each end attached into a bracket 16 opening 17. In turn, the bracket 16 can be bolted to each end of the base 15. The base 15 is made up of base members 18 and 20 which may be U-shaped metal channels which are attached to a U-shaped center base member or bracket 21 with a plurality of threaded fasteners 22. Base members 18 and 20 can be adjusted within the bracket 21 then vary the length as desired. The base channel then has the brackets 16 attached to each end for attaching the end portion 23 of the rod 14.

Figure 3:
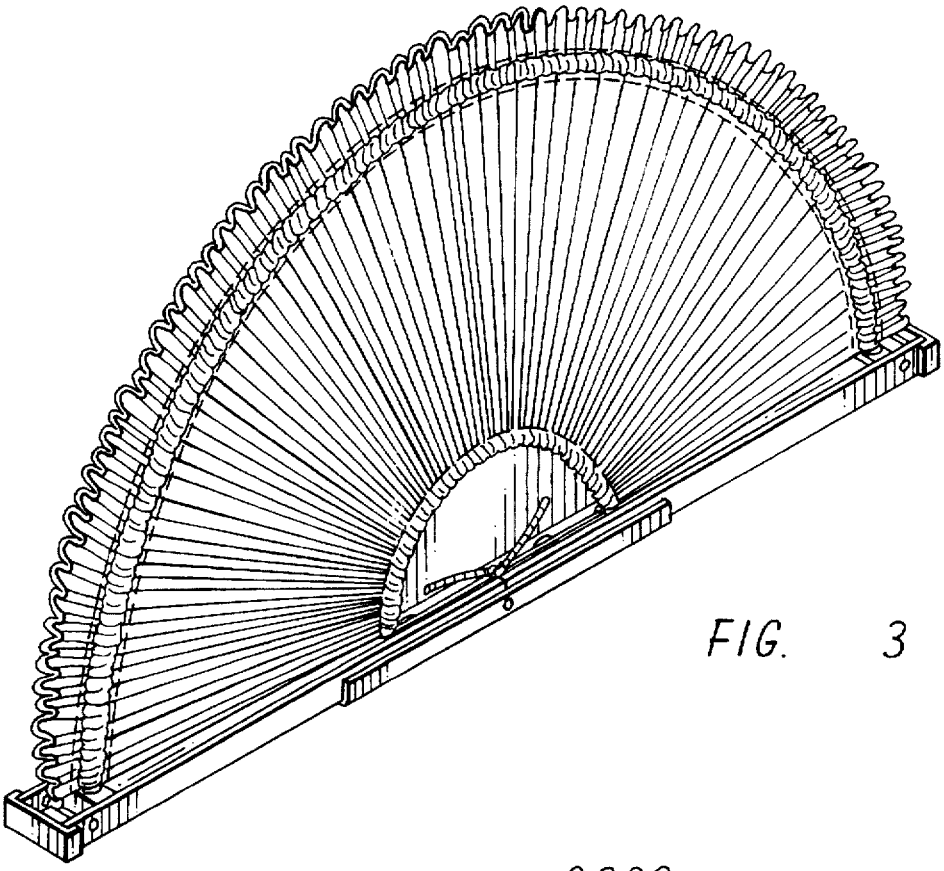
FIG. 3 is a perspective view of the rear of the arched covering of FIG. 1.
Figure 4:
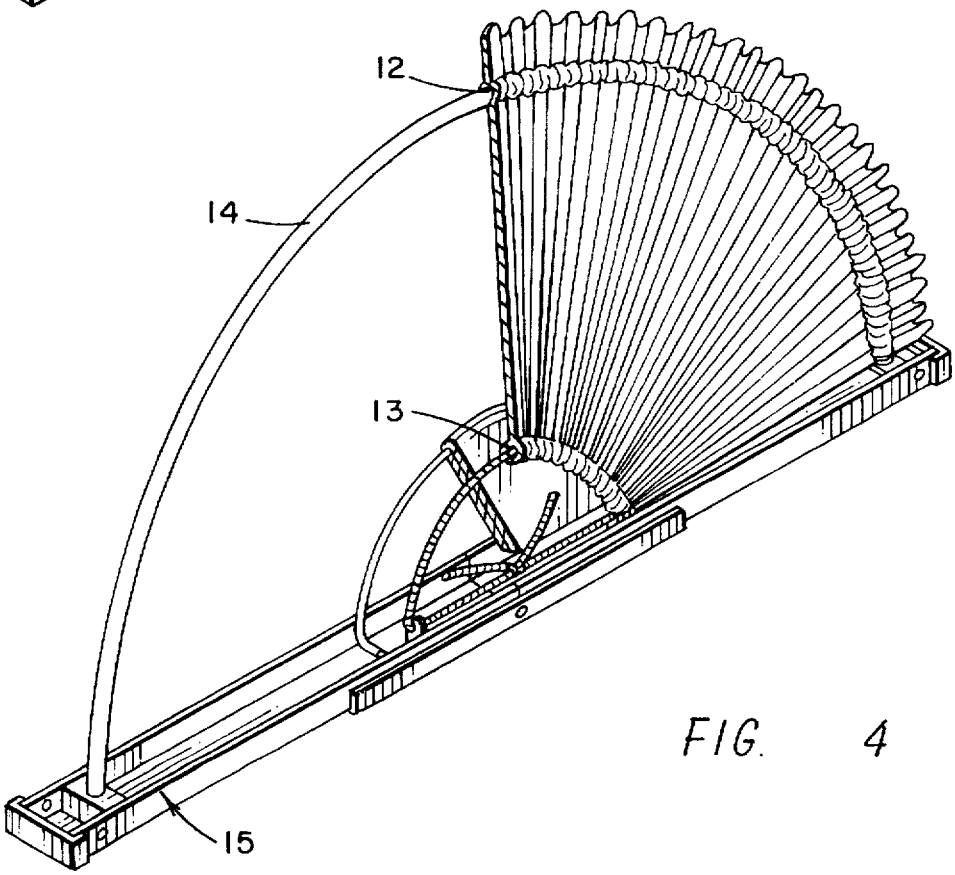
FIG. 4 is a cutaway perspective of the window coverings of FIGS. 1 and 3.

Each end portion 18 and 20 of the base also has a bracket 24 attached thereto with a threaded member 25 and has an end cap 26 attached to each end for covering the end portion. The drape 11 has the passageway 13 having a flexible cord 27 extending therethrough which can be drawn, as seen in FIG. 3, to bunch the one side of the drape 11 into a center bunch and to stretch the drape onto the rod 14. The cord 27 passes through a pair of brackets 28 which are attached to the base and allow both ends of the cord 27 to be pulled through one of the brackets where they can be pulled taunt to bunch the drape 11 in the center. The cord 27 can then be tied together to hold the drape stretched on the frame with the center bunched together.

The assembled bunch, as shown in FIG. 1, can have a center covering or cap member 31 which can be formed of a fabric 32 stretched on an arcuate fabric rod 33, which rod 33 has a pair of attaching ends or clips 34 which can be readily snapped into the U-shaped channels of the members 18 and 20 to hold the clip center member 31 in place to cover the opening left when the draw string has been pulled tight to stretch the drape 11, as shown in FIGS. 1 and 3.

Figure 2:
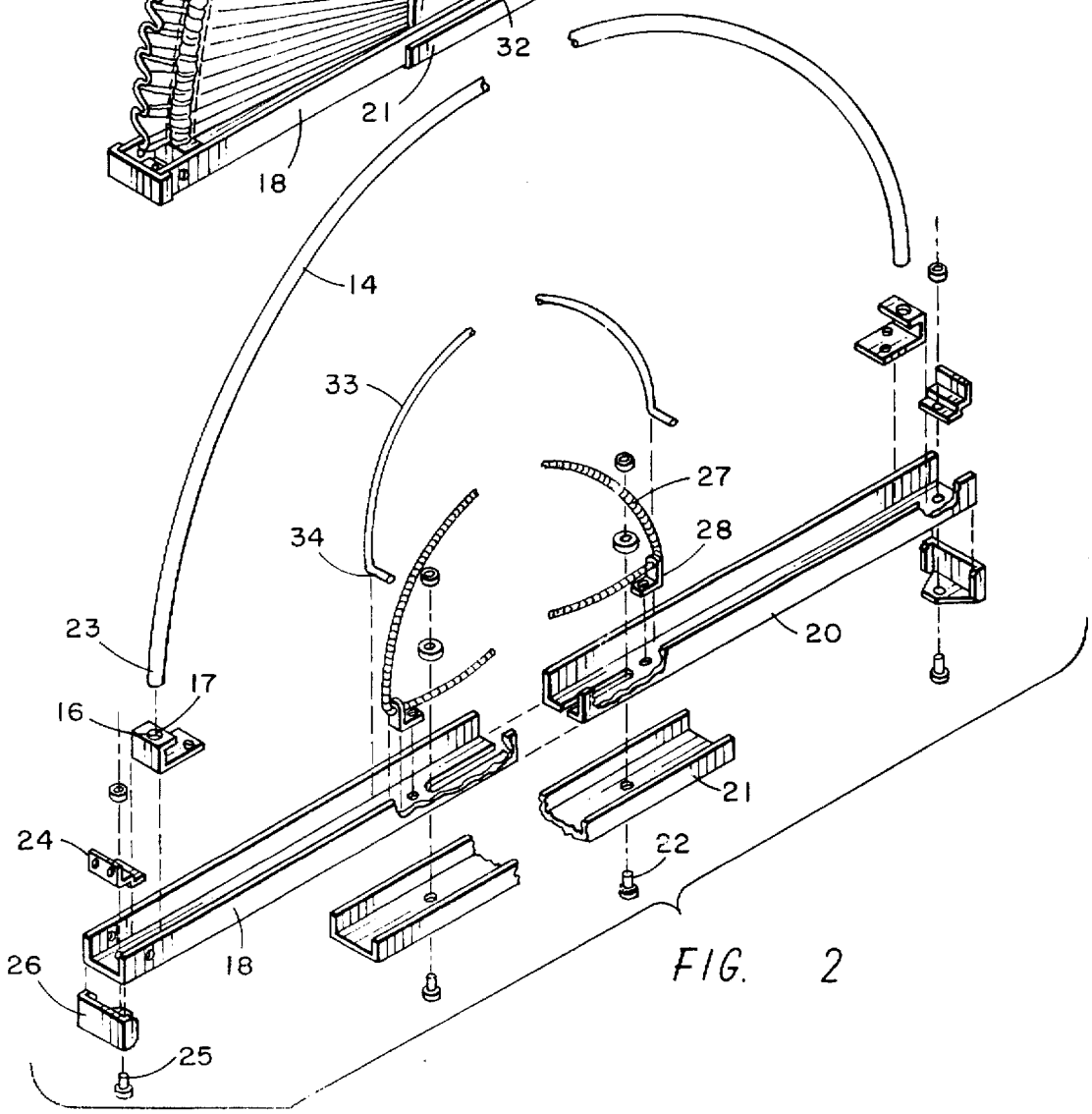
FIG. 2 is an exploded view of the drape supporting frame of the covering of FIG. 1.

In operation, the entire arched window covering can be made up with a frame, as in FIG. 2, and a fabric drape 11 which can be threaded through the drape passageway onto the rod 14. The base 15 can then be adjusted for a length of the base of the window and the rod 14 bent to form the arcuate shape by attaching one end 23 into the opening 17 of the bracket 16 and bending the arched surface to attach the other end into the opposite end bracket 16 while the drape is attached. The flexible cord 27 can then be pulled through to bunch the side of the drape toward the center to stretch the fabric drape 11, as shown in FIG. 1, with the cord passing through the brackets 28. When the drape is pulled taunt, the cord 27 is tied and the center covering 31 can be attached over the opening in the center of the arched window covering. Adjustments can be easily made by varying the length of the base by adjusting the members 18 and 20 in the bracket 21 and by cutting off the rod 14 for different size windows prior to attaching the fabric drape 11 thereto and attaching the drape rod to the base 15. The end caps 26 can be left thereon where the base is to set onto a surface or, alternatively, the brackets 24 can be used for bolting the base 15 to the sides of the window where the arched window does not have a base surface portion.

It should be clear at this time that an arched window covering has been provided which advantageously can be made of a kit form which can be readily assembled by individuals or installers and which has a wide variety of adjustments for sizing and fitting to a particular arched window. However, the arched window covering in accordance with the present invention will be made up in a variety of sizes which have individual adjustment for a particular window. The arched window coverings of the present invention also advantageously allow the covering to be easily removed for cleaning or replacement of the drape material. However, the present invention should not be considered as limited to the forms shown which are to be considered illustrative rather than restrictive.

I claim:

1. An arched window covering comprising:

an elongated rigid base having two elongated channel members removably and adjustable attached together with an elongated bracket, each said elongated channel member having two end portions and a rod attachment bracket attached to one said end portion of each elongated channel member, and said elongated rigid base having a pair of cord attachment brackets attached thereto between the ends thereof;

an elongated flexible drape support rod having two ends and being removably attached to each said elongated base rod attachment bracket to form an arch in said drape support rod;

a flexible fabric drape having a passageway formed on two sides thereof and having said drape support rod extending through one said passageway;

a flexible cord member extending through the other passageway of said flexible drape and attached to each said base cord attachment bracket; and a flexible arcuate center cover rod having two end portions and having a clip formed on each said end portion for clipping to said elongated rigid base and having a fabric material thereon for covering the center of said arched window covering whereby an arched drape is formed for covering an arched window.

2. An arched window covering in accordance with claim 1 in which each said rod attachment bracket has an opening therein for attaching one end of said elongated flexible drape support rod.

3. An arched window covering in accordance with claim 1 in which said elongated rigid base has an end cover member removably attached to each end thereof.

4. An arched window covering in accordance with claim 1 in which said two elongated channel members and said elongated bracket are bolted together.

5. An arched window covering in accordance with claim 1 in which said two elongated channel members are U-shaped metal channel members.

* * * * *